US009752846B1

(12) United States Patent
Kenaley et al.

(10) Patent No.: US 9,752,846 B1
(45) Date of Patent: Sep. 5, 2017

(54) PNEUMATIC LAUNCHING ASSEMBLY

(71) Applicant: Lurker Paintball, LLC, Hockessin, DE (US)

(72) Inventors: Ryan C. Kenaley, Hockessin, DE (US); Steven M. Lynam, Fitchburg, WI (US)

(73) Assignee: LURKER PAINTBALL, LLC, Hockessin, DE (US)

( * ) Notice: Subject to any disclaimer, the term of this patent is extended or adjusted under 35 U.S.C. 154(b) by 0 days.

(21) Appl. No.: 15/051,201

(22) Filed: Feb. 23, 2016

Related U.S. Application Data

(60) Provisional application No. 62/119,266, filed on Feb. 23, 2015.

(51) Int. Cl.
*F41B 11/721* (2013.01)
*F41B 11/57* (2013.01)

(52) U.S. Cl.
CPC ..... *F41B 11/721* (2013.01); *F41B 11/57* (2013.01)

(58) Field of Classification Search
CPC ..... F41B 11/72–11/73
See application file for complete search history.

(56) References Cited

U.S. PATENT DOCUMENTS 5,634,456 A * 6/1997 Perrone ..... F41B 11/721 124/31
7,509,953 B2 3/2009 Wood
7,779,826 B2 * 8/2010 Lian ..... F41B 11/721 124/72
7,793,644 B2 * 9/2010 Lai ..... F41B 11/721 124/73
7,861,703 B2 * 1/2011 Liao ..... F41B 11/721 124/77
7,870,852 B2 * 1/2011 Halmone ..... F41B 11/721 124/77
7,931,018 B1 * 4/2011 Lai ..... F41B 11/721 124/71
8,074,632 B2 * 12/2011 Dobbins ..... F41A 19/12 124/77
8,104,463 B2 * 1/2012 Wood ..... F41B 11/721 124/73
8,109,260 B2 * 2/2012 Maeda ..... F41B 11/62 124/73
8,261,728 B1 * 9/2012 Tseng ..... F41B 11/55 124/73
8,286,622 B2 * 10/2012 Halmone ..... F41B 11/721 124/74

(Continued)

*Primary Examiner* — Stephen M Johnson
*Assistant Examiner* — Joshua Semick
(74) *Attorney, Agent, or Firm* — Charles S. Sara; DeWitt Ross & Stevens S.C.

(57) ABSTRACT

A pneumatic projectile launcher with improved valve opening and closing characteristics includes a trigger mechanism in communication with a valve assembly, preferably through pneumatic or mechanical means. This valve assembly consists of at least two members; the first is used to seal a single projectile in a barrel tube so as to accelerate the projectile with a gas pulse ("bolt"). The second member of the assembly is a valve member which controls the release of said gas pulse. The aforementioned pulse that propels the projectile out of the barrel ("forward") also acts on a face of the valve member opposite the projectile, translating the valve member rearward to the original, closed position.

11 Claims, 9 Drawing Sheets

(56) References Cited

U.S. PATENT DOCUMENTS

| | | | | |
|---|---|---|---|---|
| 8,413,644 | B2 * | 4/2013 | Masse | F41B 11/62 124/73 |
| 8,485,172 | B2 * | 7/2013 | Tseng | F41B 11/721 124/73 |
| 2007/0028909 | A1 | 2/2007 | Wood | |
| 2007/0151549 | A1 | 7/2007 | Wood | |
| 2007/0175465 | A1 * | 8/2007 | Quinn | F41B 11/723 124/74 |
| 2009/0101129 | A1 | 4/2009 | Wood et al. | |
| 2011/0088675 | A1 | 4/2011 | Wood | |

* cited by examiner

PNEUMATIC LAUNCHING ASSEMBLY

FIELD OF THE INVENTION

The present invention relates to pneumatically operated guns and projection devices, where the launching apparatus uses non-explosive compressed gas as a propulsion source. Specifically, the present invention relates to the chambering and propulsion mechanisms for use in paintball guns, i.e., "markers."

BACKGROUND

The present invention is particularly suited to be used as a paintball marker. Paintball is a sport in which players attempt to mark their opponents by using a gun to shoot a frangible projectile. Upon contact with an opponent and sufficient trauma to rupture the frangible outer shell, paint or other marking material shall identify that the opponent player has been hit, and should be removed from the game.

Examples of paint ball marker guns are shown and described in U.S. Pat. No. 7,509,953 to Wood, and U.S. Publications Nos. 2007/0028909, 2007/0151549 and 2011/0088675 to Wood; and U.S. Publication No. 2009/0101129 to Wood et al., the entire contents of which are all incorporated full herein by reference.

Launchers are most commonly pneumatic launching devices fitted with a compressed air or liquid $CO_2$ propellant source. Commonly, launchers generally meter out gas to the ball either by using a valve that is normally closed and contacted by a reciprocating assembly to open said valve for a very short duration. Alternately, launchers may meter out gas by only allowing a fixed volume to be exposed to the ball, removing the requirement of exchanging kinetic energy from a reciprocating assembly to the valve. Oftentimes, this strategy is employed with launchers that utilize a seal that slides open to expose the projectile to gas.

Reference is made to US Patent Publication 2007/0028909 to Wood which is directed to a paintball gun with a specific mechanism for controlling the velocity of a projectile or ball. In this disclosure, the gun has a rangefinder in communication with a microprocessor to calculate the distance between the gun and the target. When the trigger is pulled, the microprocessor notes the current range to the target and directs a solenoid to allow compressed gas to pass through it to a channel for a certain time corresponding to the distance of the target. The shorter duration at the solenoid drives the piston forward, the less compressed gas enters the firing chamber to file the ball. Less compressed gas results in a slower projectile velocity meaning that the projectile will only travel toward a closer target.

U.S. Pat. No. 7,509,953 to Wood is directed to a paintball gun configured to eliminate or reduce recoil by the bolt and firing plunger coaxially moving in opposite directions to minimize recoil. In addition, the pneumatic launching assembly is self-timed to avoid misfiring. The pneumatic launching assembly also provides isolation of gas to improve overall efficiency of the assembly. In operation, the trigger mechanism initiates the launch operation. Upon actuation, gas moves the bolt from its rearward position to a forward launching position after a projectile has been loaded. While the bolt is actuated forward, the projectile is moved into the launching position in the barrel. The bolt then moves forward under control of the gas by directing compressed gas to the rear of the bolt. The firing plunger moves rearward in a coaxially opposed direction of the bolt to minimize recoil. As the firing plunger continues to move rearward, the firing plunger controls the flow of gas. Once the plunger is sufficiently rearward, the front end of the first chamber is breached which allows gas to move from the first chamber into a second chamber in order to actuate the bolt and urge it forward. When the bolt is fully forward, the projectile feeding tube is blocked and the second chamber opens to release gas to propel the projectile forward and out of the barrel. Once the gas isolated in the chamber has been released through the bolt, the firing plunger returns to the forward position as the bolt returns to the rear position. This coaxial movement of the bolt and the firing plunger, i.e., moving in opposite directions, minimizes recoil.

Typically, launchers that include a valve opened by kinetic energy have very low propellant consumption ("high efficiency"), but create more noticeable recoil to players. Launchers that employ the alternative strategy of sliding open a valve and allowing a fixed volume of air to be exposed to the ball generally create a more stable platform for launching due to decreased felt recoil, but have higher consumption rates of propellant and are therefore not as efficient.

In addition to the desired features of a stable launching platform and high gas efficiency, launchers must be able to load and accelerate the most frangible possible marker projectiles to a consistent velocity. Because the indication of elimination in the game of paintball requires the marker projectile to fracture and distribute its contents onto the opposing players to be considered a hit, it is advantageous to subject the projectile to as little stress as possible during loading and acceleration.

The ability to accelerate the projectile to a consistent velocity is desirable, because shots will be measured for velocity before and after competitive games by a chronograph. Shots that are higher than a predetermined velocity limit, typically 300 feet per second, may incur penalties to the players using a launcher that shoots over the velocity limit. By providing a launcher that has a low standard deviation for velocity, players may adjust their mean velocity very close to the limit, providing more initial kinetic energy for the projectile to fracture upon contact with opponents at long range. Thus, the probability of marking success is contingent upon imparting the most possible kinetic energy into the most fragile projectile possible, without breaking the projectile within the launcher itself. Breakage inside the launcher is highly disadvantageous, because the liquid contents of the projectile coat the assembly and barrel inner surface, creating an increased possibility of more projectile breaks, as well as decreasing the accuracy and precision of the projectile due to aerodynamic effects from liquid paint on the projectile in flight.

SUMMARY OF THE INVENTION

The present invention is directed to a pneumatic projectile launcher for launching a projectile, comprising a barrel having a bore therein; a trigger mechanism; a projectile feed port; a breech for positioning the projectile that communicates with the projectile feed port and the barrel; and a pneumatic valve assembly containing a pneumatic control valve, a pneumatic gas pressure regulator, a pneumatic gas supply chamber, wherein the pneumatic gas supply chamber receives gas at a fixed pressure from the regulator, a bolt coaxial to the bore of the barrel wherein the bolt slidably communicates with the bore in a forward and rearward positions, the bolt comprising a first forward end and a second rearward end and an internal channel, wherein the bolt is initially secured within the pneumatic control valve in a rearward position by gas from the pneumatic gas supply chamber and wherein the pneumatic gas supply chamber comprises sufficient gas to generate a rearward gas force pressure on the bolt to enable the breech to receive the projectile, wherein the bolt includes a bolt sail to generate rearward force from this gas pressure, a valve member in communication with the bolt, wherein the valve member comprises a compliant stop for engaging the internal channel of the bolt to create a seal, wherein the forward force acting on the bolt exceeds the maximum holding force of the compliant stop, wherein the trigger mechanism is in communication with the bolt and the valve member and wherein the trigger mechanism communicates with the second rearward end of the bolt through an electronic control board; and an infeed tube for feeding projectiles into the breech.

The present invention is also directed to a method of operating a pneumatic projectile launcher, described in the previous paragraph, the method comprising activating the triggering mechanism to generate a pneumatic bias to the bolt and the valve member, thereby causing valve member and the bolt to move toward the breech, wherein the bolt and valve member are sealed together by means of their coaxial arrangement, and wherein the movement of the valve member enables a flow a gas to communicate with the second end of the bolt, thereby increasing the velocity of bolt actuation; and sealing the projectile infeed tube by the movement of the bolt and valve member, wherein second rearward end of the bolt is dislodged from of the valve member placing the second rearward end of the bolt in pneumatic communication with the pneumatic gas supply chamber to enable the gas to flow in a direct path from the pneumatic supply chamber to the projectile in the barrel thereby projecting the projectile through the bore of the barrel.

The present invention provides a method of loading and accelerating a marker projectile with minimum stress placed on the projectile. In addition, it provides a very stable, i.e., low recoil, launching platform with excellent gas efficiency and excellent velocity consistency.

Without wishing to be restrained to one reason or theory for the advantages of the present invention it is believed that in the most preferred embodiment, the bolt of the launcher is made to be very lightweight, constructed from materials such as aluminum, magnesium and machined polymers. In addition, the pneumatic bias is applied gradually. This limits both the speed and momentum with which the bolt contacts the marker projectile, limiting the stress to the projectile 21 and allowing the most fragile projectiles available to be employed.

The same pulse of air propelling the projectile 21 in the forward direction also acts on the valve member 53 in the rearward direction. This action is advantageous because a large force can be applied to quickly close the valve member 53 before excess gas can be consumed. The magnitude of this force is dependent upon the pressure behind the projectile 21, creating a feedback mechanism which aids consistency in the velocity of the projectile 21 upon subsequent actuations. An improved seal will retain additional pressure behind the projectile 21, causing the valve member 53 to experience a larger acceleration, releasing less air. This compensates for imperfect seals between the projectile 21 and the barrel 16, and therefore improves consistency.

Additionally because the force is directly opposite to the acceleration of the projectile 21, a portion of the recoil caused by imparting momentum to the projectile 21 is delayed, reducing the peak of the impulse imparted to the marker by the projectile 21. This action provides the "low recoil" launching platform previously described. In many embodiments of this invention, the parts required to create the actuation method can be manufactured out of very lightweight materials, which decreases the momentum of the internal pieces, and allows for additional recoil reduction.

The closure of the valve member 53 in response to the rise in pressure its own opening creates also has advantages in the area of gas efficiency. Because the closing force is generated by the pressure resulting from the launching of the projectile 21, it can be of very large magnitude, and applied only after the bolt 50 has de-seated from the valve member 53. This means that the initial rise in pressure at the projectile 21 can be controlled directly by the speed of the bolt 50 de-seating, with the valve member 53 in the fully open position and providing little pneumatic restriction. As the valve member 53 closes, the effective flow path widens as the gap between the bolt 50 and valve member 53 grows. This allows for a very high flow rate, even at low driving pressures, while still closing the valve member 53 very quickly.

In a typical embodiment, the valve member 53 should see enough force to be fully closed before the projectile 21 has accelerated out of the barrel 16, such that all air released by the valve member 53 is sufficiently expanded by such time the projectile 21 leaves the barrel 16. In this way, the marker projectile 21 converts potential energy from the propellant gas to projectile kinetic energy with very high efficiency.

The closure of the valve member 53 controls the total amount of gas that flows to the projectile 21, which creates a feedback mechanism between the pressure accelerating the projectile 21 and the pressure closing the valve member 53. Higher pressures on the projectile 21 due to external factors, such as an improved seal between projectile 21 and barrel 16, normally create a higher velocity due to a higher average pressure on the projectile 21.

However, the pneumatic valve assembly 30 counteracts this natural inclination by closing the valve member 53 more quickly in response to the increased pressure, therefore releasing less gas. The end result of this feedback is excellent velocity consistency, due to this compensation for external variability.

Once the valve member 53 has returned to its closed position, meaning the pneumatic supply chamber 68 is isolated from the projectile 21, the bolt 50 is subsequently driven rearward to its resting position allowing another projectile 21 to be loaded for subsequent activation of the pneumatic valve assembly 30.

DETAILED DESCRIPTION OF THE INVENTION

Figure 1:
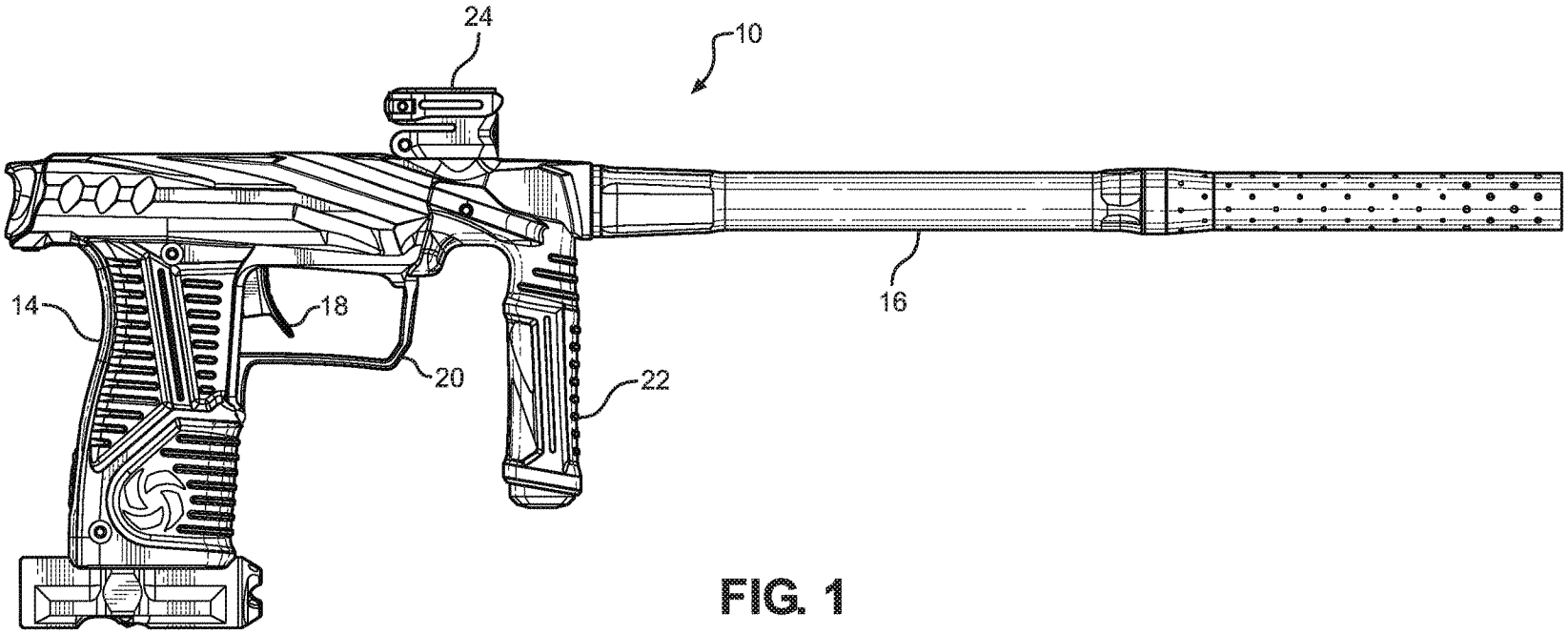
FIG. 1 is a side-elevated view of the pneumatic projectile launcher 10 or paintball gun of the present invention.

The accompanying drawings illustrate the construction of a preferred embodiment of this invention. Like elements in the drawings are represented by like numbers. "Rearward" or "backward" shall indicate the left of the page, whereas "forward" or "front" shall indicate the right side of the page.

Referring to FIG. 1, a typical paintball marker or projectile launcher 10 includes body 12 which contains the inner workings of the launcher 10, a grip or handle 14, a barrel 16 and a trigger 18 typically placed within a trigger guard 20. As used in this disclosure, the term "paintball marker" and "projectile launcher" or "launcher" are used interchangeably to refer to the compressed gas gun described herein. Protruding downwardly from the barrel 16 can be a secondary support handle 22, which allows the user to grip the launcher 10 with two hands for better control and accuracy. An infeed tube 24 is provided for feeding projectiles 21 into a breech 60 as described below. It is well known to the art to provide a hopper or magazine in connection with the infeed tube 24 to store additional projectiles 21 for placement in the infeed tube 24.

Figure 2:
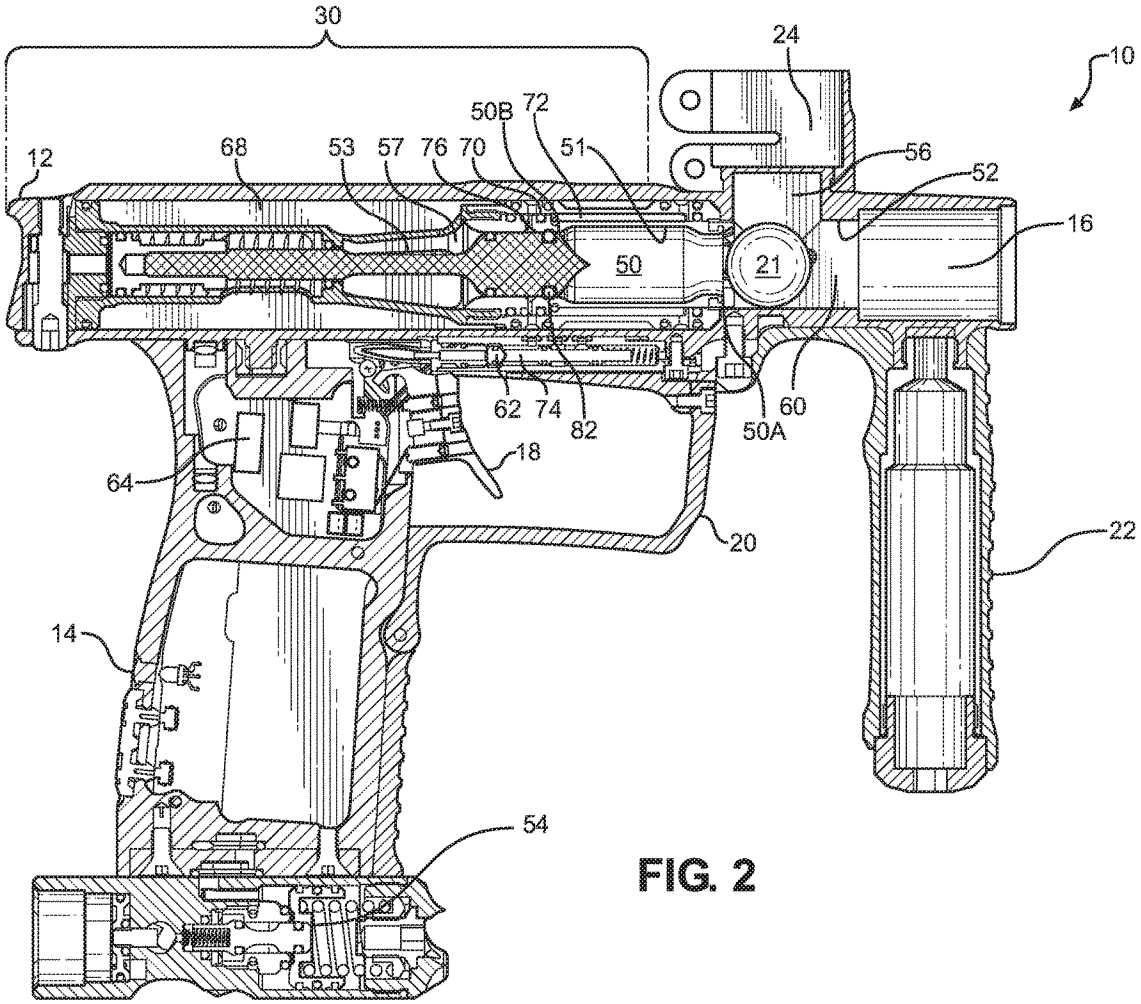
FIG. 2 is a cross-sectional elevated side view of the pneumatic projectile launcher 10 of the present invention which illustrates the pneumatic projectile launcher 10 at rest before any activation has been made through the trigger 18 mechanism. In this figure, the launcher 10 is at rest, ready to fire. A projectile 21 or ball is loaded in the breech 60, the piloted valve is at rest and the trigger 18 has not been pulled.

Referring to FIG. 2, the launcher 10 includes a pneumatic valve assembly 30 containing a cylindrical bolt 50 that is coaxial to the bore 52 of the barrel 16 of the projectile launcher 10 and a valve member 53. The bolt 50 has a first forward end **50*a* and a second rearward end 50*b* and a central channel 51 and slides back and forth between forward and rearward positions, preferably limited by mechanical stops. A triggering mechanism or trigger 18, of electronic or mechanical means, is linked to the bolt 50 and valve member 53. The pneumatic valve assembly 30 also includes a pneumatic gas pressure regulator 54, a projectile feed port 56, a breech 60 for positioning the projectile 21 that communicates with the feed port 56 and barrel 16, and a pneumatic control valve 62 operated either by mechanical or electronic means. In a preferred embodiment, the trigger 18 communicates with the rear of the bolt 50 through an electronic control board 64, and a solenoid-driven pilot valve (not illustrated) is used to actuate the pneumatic control valve 62 to initiate the pneumatic action. The pneumatic control valve 62** may also be actuated directly, such as by an electromagnetic actuator, or a manual or pneumatic switch (not illustrated).

FIG. 2 illustrates the pneumatic valve assembly 30 with the bolt 50 in rearward position. The rearward bolt 50 position allows a new projectile 21 to move into the breech 60, as illustrated, leaving the breech 60 open to receive the projectile 21. The bolt 50 is secured within the body of the launcher 10 and is held in the rearward position by air that is routed through the solenoid operated pneumatic control valve 62 from the pneumatic supply chamber 68. The supply chamber 68 receives air at a fixed pressure from the regulator 54. The bolt 50 includes a bolt sail 70 to generate rearward force from this gas pressure contained in the pneumatic sear volume 72.

Figure 3:
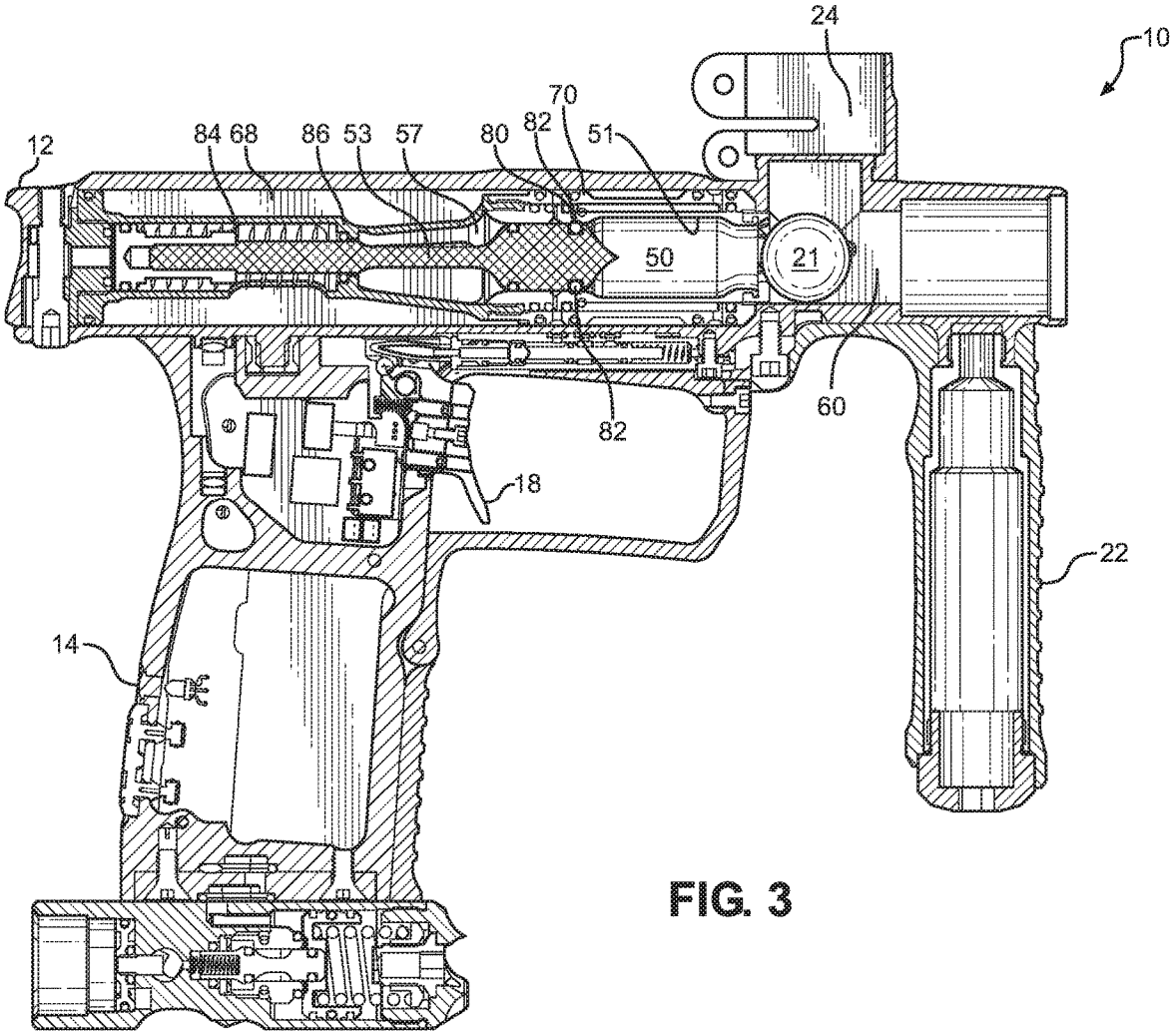
FIG. 3 is a cross-sectional elevated side view of the pneumatic projectile launcher 10 of FIG. 1 which illustrates the pneumatic projectile launcher 10 after the pneumatic control valve 62 has been switched, moving the bolt 50 forward to chamber a projectile 21. The internal ridge 80 of the bolt 50 has been brought into contact with the compliant stop 82 of the valve member 53, to transfer force from the bolt 50 to the valve member 53. In this figure, the trigger 18 has been pulled. This activates a solenoid-driven pilot valve (not illustrated). The air from the pilot valve shifts the pneumatic control valve spool 74 to "actuated". This isolates the air from the pneumatic supply chamber 68, and puts the volume in front of the bolt sail 70 in communication with the volume behind the bolt 50, causing the bolt 50 to move forward, also dragging the valve member 53 forward by the force applied to the compliant stop 82.

Upon activation of the triggering mechanism 18 as illustrated in FIG. 3, a pneumatic bias is applied to either the bolt 50 or the valve member 53, causing the bolt 50 to move forward with a low amount of speed and force. During the initial actuation of the valve member 53, the bolt 50 and valve member 53 are sealed together by means of their coaxial arrangement. When the bolt 50 reaches a position that is concomitant with successful initiation of the loading of the projectile 21 into the barrel 16, the valve member 53 will be moved forward to a position such that air from the pneumatic supply chamber 68 is in communication with the rear of the bolt 50, increasing the velocity of bolt 50 actuation. The bolt 50 then reaches a forward position at which the projectile infeed tube 24 is fully sealed, and the valve member 53 reaches the extent of its travel. At this position the bolt 50 is dislodged forward of the valve member 53, to the bolt's full forward position, allowing air to flow in a direct path from the pneumatic supply chamber 68 to the projectile 21 placed in the barrel 16. Once this direct path has been established, the valve member 53 is only free to travel in one direction, i.e., away from the projectile 21. Moving the bolt 50 to the forward position seals the projectile 21 in the barrel 16 and allows a gas pulse to act on the projectile 21 without leaking to the projectile feed port 56.

Referring now to FIG. 3, upon traveling forward some predetermined distance, the bolt 50 engages an internal ridge 80, having a reduced inner diameter compared to the remainder of the bolt 50, with a compliant stop 82 seated in the forward end of the valve member 53. The valve member 53 is normally held in the rearward position sealing the pneumatic supply chamber 68 from the breech 60 and bolt 50. The rearward bias of the valve member 53 may be accomplished by magnetic, pneumatic, or spring means. A rearward bias is also not a requirement of this invention, as a valve member 53 without a force bias but with a friction, magnetic, or other holding element would function in a similar fashion. In this preferred embodiment, a valve spring 84 is used to provide some rearward bias to the valve member 53 during the entire cycle, acting against the valve forward stop 86. The valve member 53 may travel forward a small distance without de-seating, in order to prevent misfires caused by the bolt 50 becoming jammed on the projectile 21. Additionally, a permanent magnet 90 may be used to latch the valve member 53 in the rearward position. The valve member 53 is preferably aluminum, and so would require a ferrous or magnetic rear holding plate 92 to generate the rearward magnetic holding force. The magnetic latching system serves to eliminate any oscillation as the valve member 53 returns to the rest position shown in FIGS. 2 and 3.

The drop in attractive magnet force as the valve member 53 moves forward also ensures that the opening of the valve member 53, which increases the pressure on the bolt 50, does not cause the bolt's internal ridge 80 to fully slip over the compliant stop 82. For the system to function reliably, the forward force acting on the bolt 50 must exceed the maximum holding force of the compliant stop 82, in order to allow the bolt 50 to complete a full forward cycle. The maximum holding force of the compliant stop 82 must exceed the net rearward force on the valve member 53 in order to allow the bolt 50 to pull the valve member 53 forward until the valve member 53 engages with the valve forward stop 86.

Figure 4:
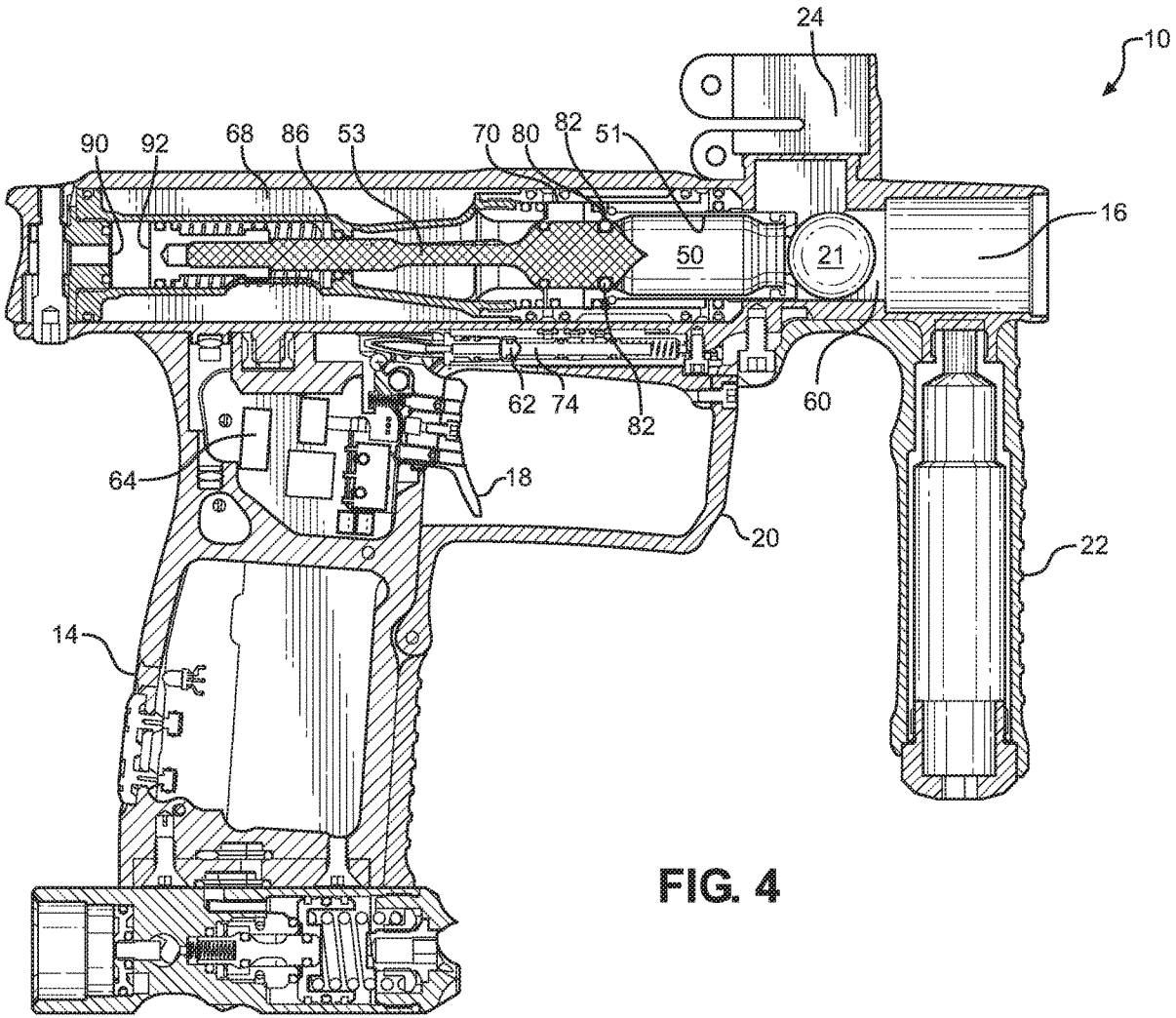
FIG. 4 is a cross-sectional elevated side view of the pneumatic projectile launcher 10 of FIG. 1 which illustrates the pneumatic projectile launcher 10, with the bolt 50 still in contact with the compliant stop 82, and the valve member 53 remains in contact with the valve body 57, keeping the back of the bolt 50 isolated from the pneumatic supply chamber 68. In this figure, the bolt 50 reaches the end of the "pinch stroke." At this point the projectile 21 has been mechanically verified to be fully loaded in the breech 60.

Referring now to FIG. 4, when the bolt internal ridge 80 engages the compliant stop 82 on the valve member 53, the valve member 53 is moved forward with the bolt 50's action, because the force applied by the bolt 50 is larger than the rearward valve member 53 holding force. When the valve member 53 moves forward, it places the rear of the bolt 50 in pneumatic communication with the pneumatic supply chamber 68. This increases the force on the bolt 50 to a maximum, defined by the pressure in the pneumatic supply chamber 68. Because the valve member 53 is sealed with the bolt 50, no gas can reach the projectile 21 at this stage. When the valve member 53 reaches a full forward travel, it contacts the valve forward stop 86 and stops moving forward.

Figure 5:
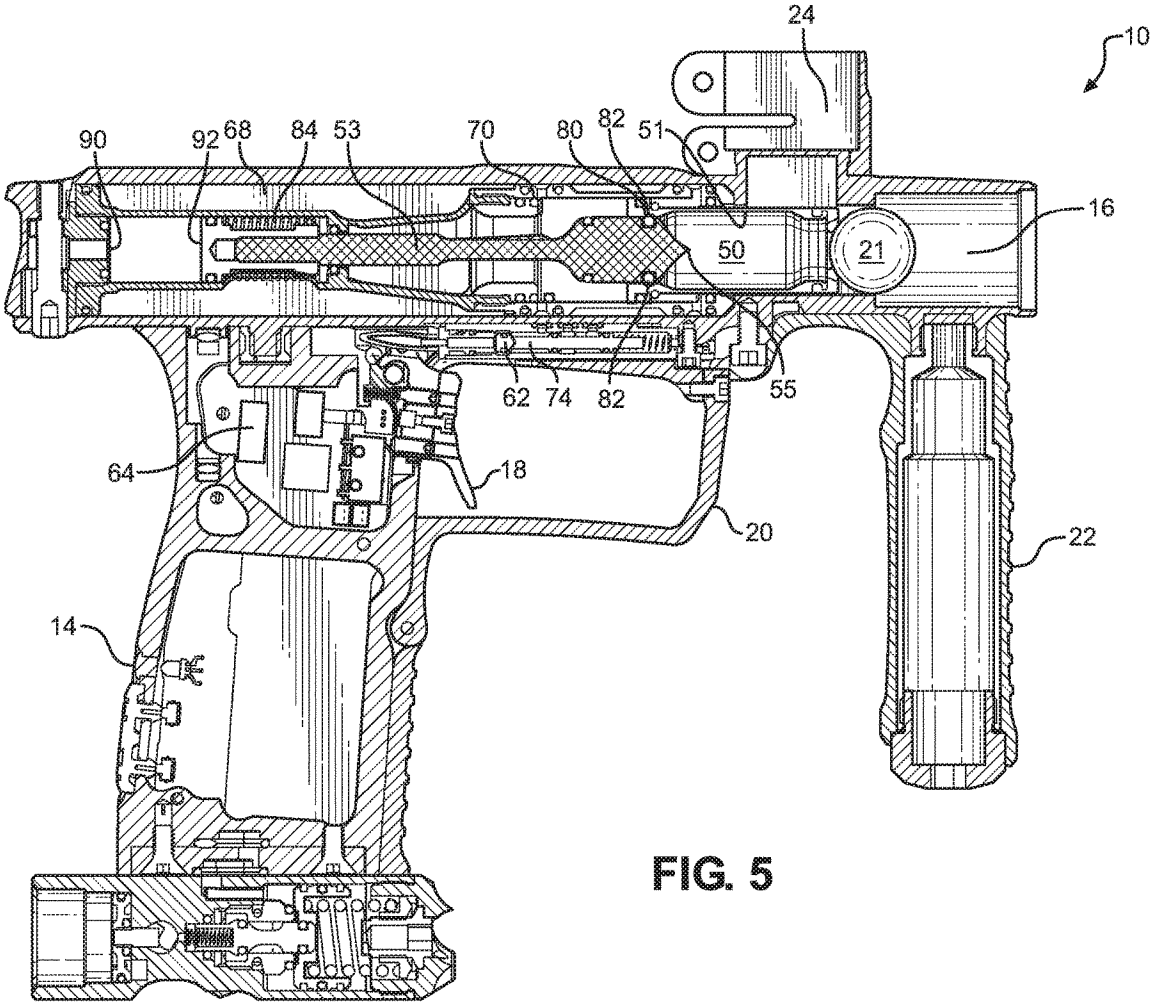
FIG. 5 is a cross-sectional elevated side view of the pneumatic projectile launcher 10 of FIG. 1 which illustrates the pneumatic projectile launcher 10, with the bolt 50 still in contact with the compliant stop 82, and the valve member 53 stopped at its full forward travel by the valve forward stop 86. The valve member 53 is no longer in contact with the valve body 57 exposing the back of the bolt 50 to pressure from the pneumatic supply chamber 68. This causes the bolt 50 to move forward more rapidly.
Figure 6:
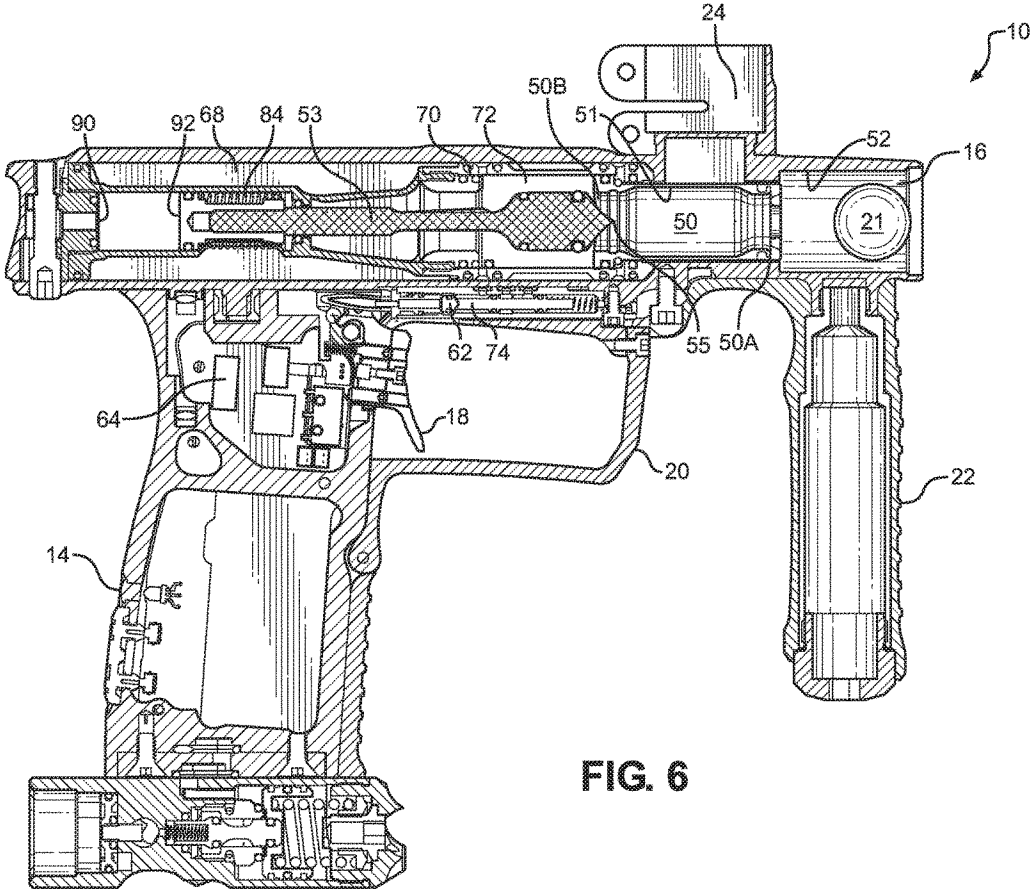
FIG. 6 is a cross-sectional elevated side view of the pneumatic projectile launcher 10 of FIG. 1 which illustrates the pneumatic projectile launcher 10, with the bolt 50 internal ridge 80 having passed over the compliant stop 82, allowing the bolt 50 to move forward to its full forward position. Therefore the pneumatic supply chamber 68 is in fluid communication with the breech 60, propelling the projectile 21 down the barrel 16. At this point the valve member 53 is exposed to a large net force in the rear direction due to the pressure accelerating the projectile 21, which quickly accelerates valve member 53 rearward to make contact with the valve body 57.

Referring now to FIGS. 5 and 6, the bolt 50 has sufficient forward force to allow the bolt internal ridge 80 to pass the compliant stop 82, allowing the bolt 50 to continue to move forward, opening a gap 83 for compressed gas to flow between the front tip 55 of the valve member 53 and the rearward end **50*b* of the bolt member 50**. In this embodiment, the path of flow can have a large cross sectional area and incorporate gradual transitions, to reduce energetic losses and increase gas efficiency of the launching mechanism.

Figure 7:
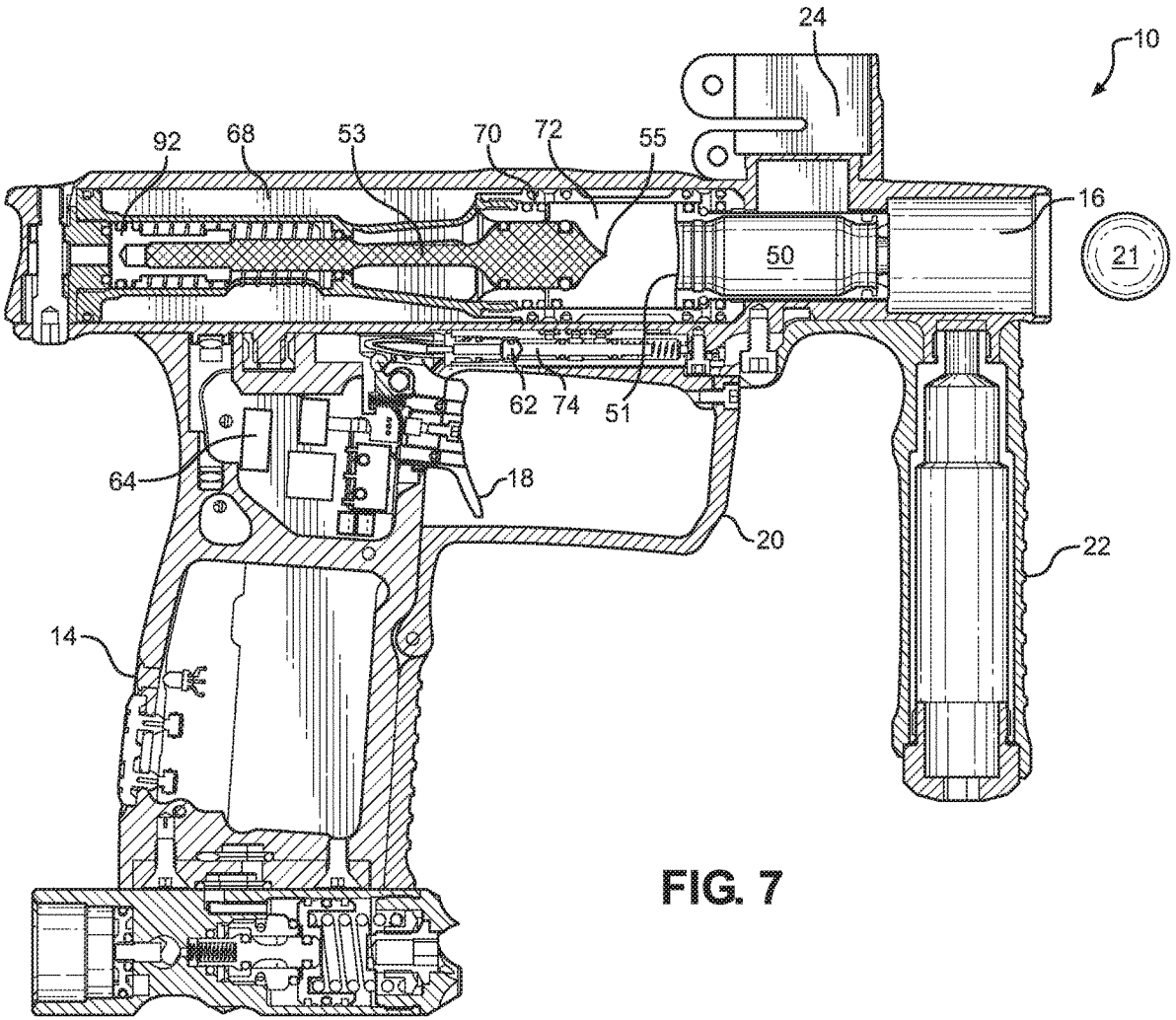
FIG. 7 is a cross-sectional elevated side view of the pneumatic projectile launcher 10, with the valve member 53 having been reset to the rearward position in contact with the valve body 57, isolating the pneumatic supply chamber 68 from the breech 60, while the bolt 50 remains in the forward position. In this embodiment, the bolt 50 will not return to the reset position until the pneumatic control valve spool 74 returns to its original position, allowing the pneumatic supply chamber 68 to communicate with the volume in front of the bolt sail 70. In this figure, air has been released to the projectile 21 and it has begun traveling down the barrel 16. In this figure, the valve member 53 has fully returned and made contact with the valve body 57, sealing the pneumatic supply chamber 68. The bolt 50 remains forward.

Referring now to FIGS. 6 and 7, as pressure builds behind the projectile 21 in the bore 52, the pressure also acts on the front tip 55 of the valve member 53, causing the valve member 53 to quickly move into the rearward position. Gas flows from the pneumatic supply chamber 68 to the projectile 21 only when the bolt 50 is de-seated from the valve member 53, as first illustrated in FIG. 7, and the valve member 53 is in the forward position. In this manner, the gas flow can be very quickly cut off while the bolt 50 continues to seal the projectile feed port 56.

FIG. 7 shows the pneumatic valve spool 74 remaining in the activated position. The trigger 18 remains depressed. In this figure, the valve member 53 has fully returned and sealed the pneumatic supply chamber 68. The bolt 50 remains forward, as the pneumatic sear volume 72 remains in communication with atmospheric pressure. No force holds the bolt forward, other than friction.

Figure 8:
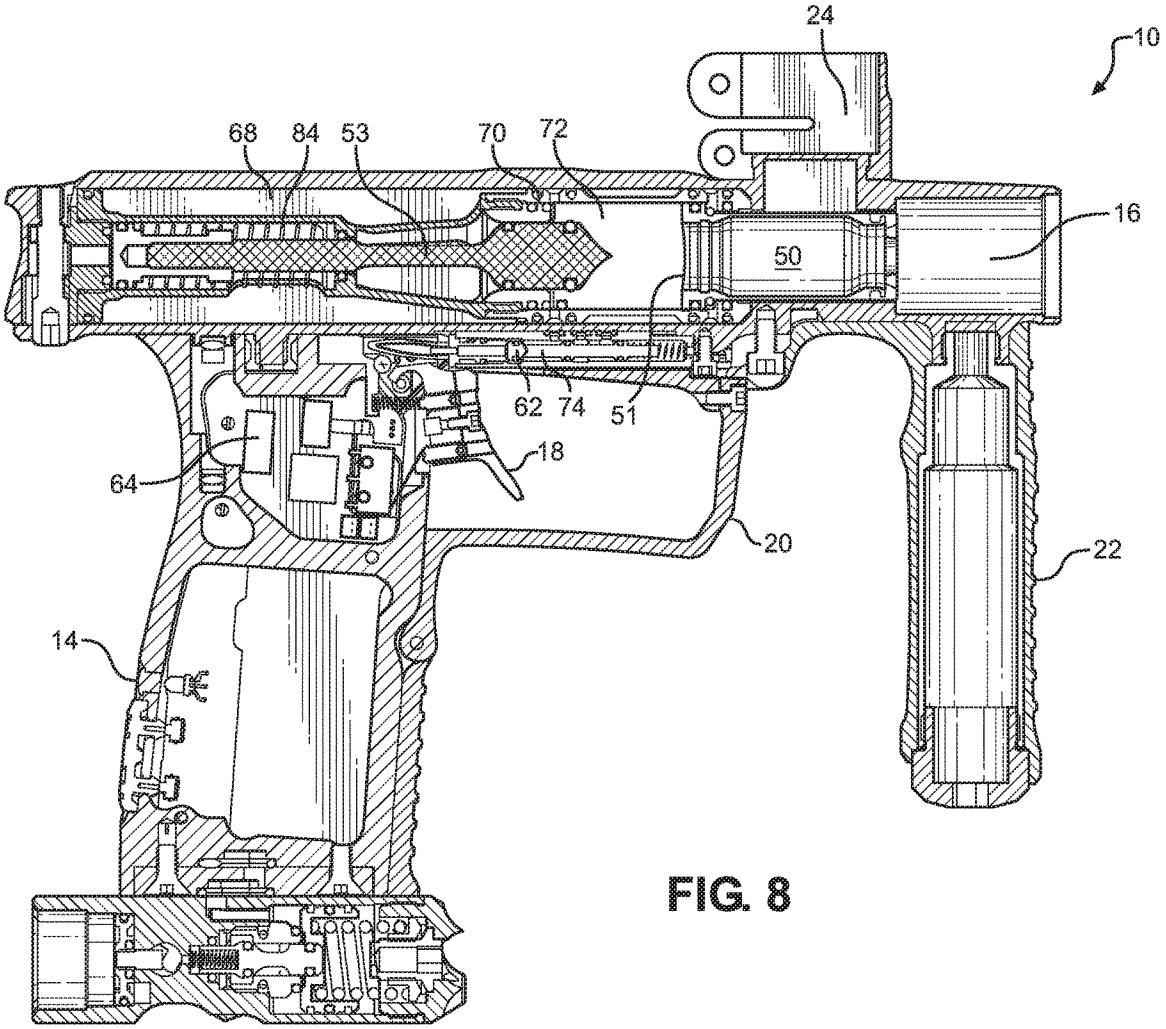
FIG. 8 is a cross-sectional elevated side view of the pneumatic projectile launcher 10. In this figure, due to releasing the trigger 18 or an electronically controlled "dwell" time expiring, the solenoid-driven pilot valve (not illustrated) vents the air pressurizing the pneumatic control valve 62 and the pneumatic control valve spool 74 shifts back to "resting." This places the pneumatic supply chamber 68, which is continuously fed an air supply from a regulator 54, into communication with the pneumatic sear volume 72.

FIG. 7 is an extension of FIG. 8, showing how a switched pneumatic source may be used in place of the solenoid-driven pilot valve (not illustrated) as the motivating force on pneumatic spool 74. In this embodiment, additional pressure is routed to the rearward end **50*b* of bolt 50, causing it to move to the compliant seal 82. The pressure building behind bolt 50 is sufficient to cause the pneumatic spool 74 to shift, placing the pneumatic supply chamber 68 in communication with the rearward end 50*b* of the bolt 50. The shifting of the pneumatic spool 74 in this case also isolates the air behind the bolt 50 and the air released by the valve member 53** from the pneumatic switch that initiated the firing cycle. In this embodiment the pneumatic source switch may be a SMAV-3 series valve (Clippard Minimatic, Cincinnati, Ohio) or similar pneumatic valve.

Referring to FIG. 8, with the release of the trigger 18, the solenoid-driven pilot valve (not illustrated) vents the air pressurizing the pneumatic control valve 62 and the piloted valve spool 74 shifts back to "resting" position.

Figure 9:
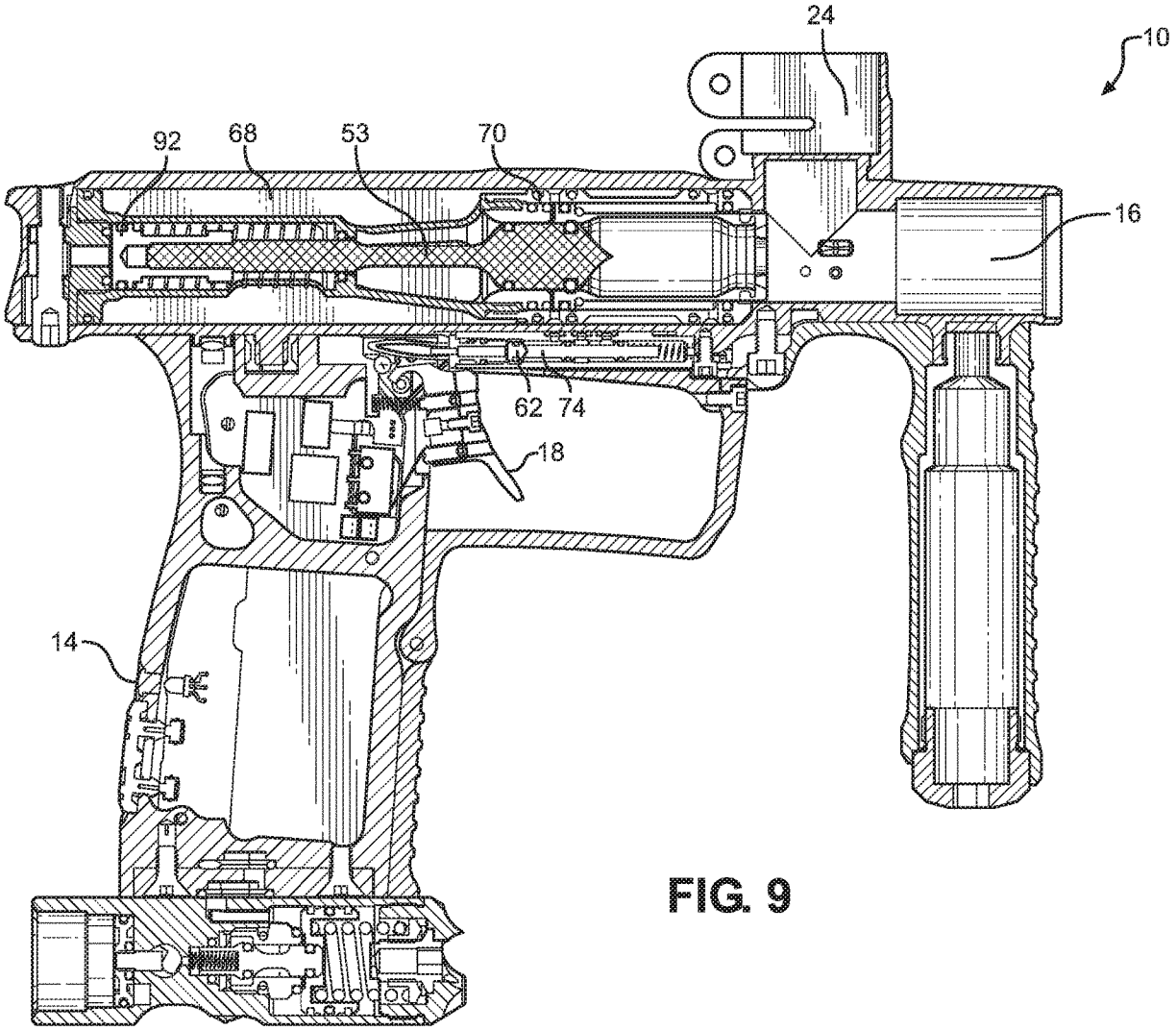
FIG. 9 is a cross-sectional elevated side view of the pneumatic projectile launcher 10. In this figure, the pneumatic control valve 62 is now putting the pneumatic supply chamber 68 in communication with the pneumatic sear volume 72, forcing the bolt 50 back and resetting it past the compliant stop 82. A new projectile 21 may now be loaded and the launcher 10 is ready to be fired again.

Referring to FIG. 9, the pneumatic control valve 62 is now putting the pneumatic supply chamber 68 in communication with the front of the bolt sail 70, forcing the bolt 50 back and resetting it past the compliant stop 82. A new projectile 21 may now be loaded and the launcher 10 is ready to be fired again.

In operation and upon trigger 18 activation, the control board 64 sends an electrical signal to the solenoid-driven pilot valve (not illustrated) provided that the control board 64 determines a firing event is warranted. This shifts the solenoid operated pneumatic valve spool 74. The solenoid operated pneumatic control valve 62 puts the pneumatic sear volume 72 in pneumatic communication with the rear face of the bolt 50, simultaneously reducing rearward force and applying forward force to the bolt 50. The application of force to the pneumatic valve spool 74 may be accomplished by means of an electromechanical actuator or through pneumatic means. Upon deactivation of the motivating force on the pneumatic valve spool 74, the rest position is restored and air flows from the tank source through the regulator 54 to the pneumatic sear volume 72 located in front of the bolt 50. The rear of the bolt 50 is placed in pneumatic communication with atmosphere to allow the bolt 50 to return to the rearward position, allowing the breech 60 to receive a new projectile 21.

The new configuration of the solenoid operated pneumatic control valve 62 puts the pneumatic sear volume 72 in pneumatic communication with the rear face 76 of the bolt 50, simultaneously reducing rearward force and applying forward force to the bolt 50. The communication between the pneumatic supply chamber 68 and the pneumatic sear volume 72 is eliminated. The ratio between the forward facing area of the bolt sail 70 and the rearward facing area of the bolt sail 70 defines the ratio of pressure at which the bolt 50 begins to move forward. The bolt 50 will move forward only as quickly as the solenoid operated pneumatic control valve 62 can flow gas to maintain the requisite pressure ratio.

In a preferred arrangement, the bolt 50 is held in the rearward position by pneumatic pressure. The weight of bolt 50 is minimal through use of lightweight materials such as aluminum, magnesium, or machined polymer. When the trigger 18 switch is activated, the pressure is routed to the rearward end 50*b* of the bolt 50, simultaneously decreasing the rearward holding force acting on the bolt 50 and increasing the forward force on the bolt 50, driving the bolt 50 forward. The valve member 53 is actuated by a compliant stop 82 between the bolt 50 and valve member 53 that allows the force of the bolt 50 to be transmitted to the valve member 53. The weight of valve member 53 may be adjusted by the use of materials and the change in total valve member 53 volume, as the valve member 53 mass will affect how the momentum imparted backwards to cancel the momentum of the projectile 21. In the most preferred embodiment the valve member 53 is stainless steel. The bolt 50 seals the breech 60 only after the valve member 53 de-seats from the valve body 57. The valve member 53 may travel forward a small distance without de-seating, in order to prevent misfires caused by the bolt 50 becoming jammed on the projectile 21. The valve member 53 de-seats, exposing a path from the pneumatic supply chamber 68 to the rear of the bolt 50, increasing the pressure behind the bolt 50 to a maximum of the pneumatic supply chamber 68 pressure. Upon reaching the full forward travel of the valve member 53, the bolt 50 force is sufficient to cause the bolt 50 to pass over the compliant stop 82 and open a flow path to the projectile 21 by de-seating from the valve member 53. Upon closure of the valve member 53, the bolt 50 is subsequently driven rearward by controlled pneumatic pressure.

In the preferred embodiment of the present invention, the bolt 50 and valve member 53, as well as the launcher 10, can all be machined from aluminum. The valve forward stop 86 can be machined from polyoxymethylene or a similar polymer.

Other embodiments of bolt 50 or valve member 53 actuation are possible. For example, the bolt 50 may be exposed to a constant forward force from a slight imbalance of the valve member 53, and be actuated only by reducing a rearward holding force applied to the bolt 50. Another alternative embodiment would utilize a simple compression spring to reset the bolt 50, and rely only on the addition of pressure to the rear of the bolt 50 to drive the bolt 50 and valve member 53 forward. Another embodiment would initially apply a force to the valve member 53, driving both the valve member 53 and bolt 50 forward, until the pneumatic supply chamber 68 has been put in communication with the rear of the bolt 50. Another embodiment would utilize a constant forward force, either on the bolt 50 or on the valve member 53 as previously described, but utilize a sear plate to release the forward force to initiate the marker launching cycle.

Acting in the manner described has multiple benefits. These benefits include cancellation of momentum imparted to the projectile 21 with momentum simultaneously imparted to the valve member 53, and very low gas consumption rates enabled by the use of high flow valves with very fast opening and closing times. In this case, the valve member 53 opening speed is wholly determined by the speed of actuation of the bolt 50, which is controlled by flow out of the pneumatic sear volume 72. The valve member 53 closing speed is determined by the pressure pulse acting on the projectile 21 and the mass of the valve member 53. This method of actuation has the additional advantage of a feedback mechanism that closes the valve more quickly as more force is applied to the projectile 21 via the same launching force acting in an opposite direction on the valve member 53. This feedback mechanism reduces the influence of external perturbing forces on the velocity of the projectile 21 leaving the barrel 16. Launching assemblies with low deviations from a desired velocity are desirable, as the trajectory of consistently launched projectiles is more predictable and more energy can be imparted to a projectile without risk of exceeding predefined velocity limits on a given shot. With the projectile 21 having already been fired, the electronic control board 64 may arbitrarily end the firing cycle. This allows for the use of manually operated pilot switches, giving the operator direct control over the position of the bolt, a desirable quality in the relevant market of the invention.

All combinations of method steps as used herein can be performed in any order, unless otherwise specified or clearly implied to the contrary by the context in which the referenced combination is made.

As used herein, the singular forms "a," "an," and "the" include plural referents unless the content clearly dictates otherwise.

Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All patents, patent publications, and peer-reviewed publications (i.e., "references") cited herein are expressly incorporated by reference in their entirety to the same extent as if each individual reference were specifically and individually indicated as being incorporated by reference. In case of conflict between the present disclosure and the incorporated references, the present disclosure controls.

The devices, methods, compounds and compositions of the present invention can comprise, consist of, or consist essentially of the essential elements and limitations described herein, as well as any additional or optional steps, ingredients, components, or limitations described herein or otherwise useful in the art.

While this invention may be embodied in many forms, what is described in detail herein is a specific preferred embodiment of the invention. The present disclosure is an exemplification of the principles of the invention is not intended to limit the invention to the particular embodiments illustrated. It is to be understood that this invention is not limited to the particular examples, process steps, and materials disclosed herein as such process steps and materials may vary somewhat. It is also understood that the terminology used herein is used for the purpose of describing particular embodiments only and is not intended to be limiting since the scope of the present invention will be limited to only the appended claims and equivalents thereof.

We claim:

1. A pneumatic projectile launcher for launching a projectile, comprising:

a. a barrel having a bore therein;

b. a trigger mechanism;

c. a projectile feed port;

d. a breech for positioning the projectile that communicates with the projectile feed port and the barrel;

e. a pneumatic valve assembly comprising:

i. a pneumatic control valve;

ii. a pneumatic gas pressure regulator;

iii. a pneumatic gas supply chamber, wherein the pneumatic gas supply chamber receives gas at a fixed pressure from the regulator;

iv. a bolt coaxial to the bore of the barrel wherein the bolt slidably communicates with the bore in a forward and rearward positions, the bolt comprising a first forward end and a second rearward end and an internal channel, wherein the bolt is initially secured within the pneumatic control valve assembly in a rearward position by gas from the pneumatic gas supply chamber and wherein the pneumatic gas supply chamber comprises gas, wherein said gas generates a rearward gas force pressure on the bolt to enable the breech to receive the projectile, wherein the bolt includes a bolt sail to generate rearward force from the rearward gas force pressure;

v. a valve member in communication with the bolt, wherein the valve member comprises a compliant stop for engaging at least a forward surface of at least one internal ridge in the internal channel of the bolt to create a seal, wherein a forward force acting on the bolt exceeds a maximum holding force of the compliant stop to force the at least one internal ridge over and beyond the compliant stop, wherein the trigger mechanism is in communication with the bolt and the valve member and wherein the trigger mechanism communicates with the second rearward end of the bolt through an electronic control board; and vi. an infeed tube for feeding projectiles into the breech; and f. a device causing a rearward bias of the valve member within the bore.

2. The pneumatic projectile launcher of claim 1 wherein the device is selected from the group consisting of a spring, pneumatic control and a magnet.

3. The pneumatic projectile launcher of claim 1 further comprising a valve spring within the pneumatic valve assembly for providing a rearward bias to the valve member.

4. The pneumatic projectile launcher of claim 1 further comprising a permanent magnet within the pneumatic valve assembly to latch the valve member in the rearward position.

5. The pneumatic projectile launcher of claim 1 further comprising a valve forward stop within the pneumatic valve assembly to stop forward movement of the valve member.

6. The pneumatic projectile launcher of claim 1 wherein the valve member is made of aluminum.

7. The pneumatic projectile launcher of claim 1 further comprising a handle.

8. The pneumatic projectile launcher of claim 1 further comprising a secondary support handle protruding downwardly from the barrel.

9. A method of operating a pneumatic projectile launcher to launch a projectile, wherein the pneumatic projectile launcher comprises a barrel having a bore therein; a trigger mechanism; a projectile feed port; a breech for positioning the projectile that communicates with the projectile feed port and the barrel; a pneumatic valve assembly comprising a pneumatic control valve, a pneumatic gas pressure regulator, a pneumatic gas supply chamber, wherein the pneumatic gas supply chamber receives gas at a fixed pressure from the regulator, a bolt coaxial to the bore of the barrel wherein the bolt slidably communicates with the bore in a forward and rearward positions, the bolt comprising a first forward end and a second rearward end and an internal channel, wherein the bolt is initially secured within the pneumatic control valve assembly in a rearward position by gas from the pneumatic gas supply chamber and wherein the pneumatic gas supply chamber comprises gas, wherein said gas generates a rearward gas force pressure on the bolt to enable the breech to receive the projectile, wherein the bolt includes a bolt sail to generate rearward force from the rearward gas force pressure; a valve member in communication with the bolt, wherein the valve member comprises a compliant stop for engaging at least a forward surface of at least one internal ridge in the internal channel of the bolt to create a seal, wherein a forward force acting on the bolt exceeds a maximum holding force of the compliant stop, wherein the trigger mechanism is in communication with the bolt and the valve member and wherein the trigger mechanism communicates with the second rearward end of the bolt through an electronic control board; an infeed tube for feeding projectiles into the breech; and a device causing a rearward bias of the valve member within the bore, the method comprising:

a. activating the triggering mechanism to generate a pneumatic bias to the bolt and the valve member, thereby causing the valve member and the bolt to move toward the breech, wherein the bolt and valve member are sealed together by means of their coaxial arrangement, and wherein movement of the valve member enables a flow a gas to communicate with the second rearward end of the bolt, thereby increasing the velocity of bolt actuation; and b. sealing the projectile infeed tube by movement of the bolt and valve member, wherein the second rearward end of the bolt is dislodged from the valve member by forcing the at least one internal ridge over and beyond the compliant stop, placing the second rearward end of the bolt in pneumatic communication with the pneumatic gas supply chamber to enable the gas to flow in a direct path from the pneumatic supply chamber to the projectile in the barrel thereby projecting the projectile through the bore of the barrel.

10. The method of claim 9 wherein the valve member is dislodged from the bolt by means of a valve forward stop.

11. The method of claim 9 wherein the gas flowing in a direct path from the pneumatic supply chamber to the projectile further acts upon the valve member thereby directing valve member to move in a rearward position with respect to the breech to reseat the valve member and stop gas flow from the pneumatic gas supply chamber.

* * * * *